US007270120B2

(12) United States Patent
Broersma et al.

(10) Patent No.: US 7,270,120 B2
(45) Date of Patent: Sep. 18, 2007

(54) HOPPERLESS PAINTBALL LOADING DEVICE

(76) Inventors: Lester V. Broersma, 515 Main St., Chula Vista, CA (US) 91911; Joseph Landry, 515 Main St., Chula Vista, CA (US) 91911

( * ) Notice: Subject to any disclaimer, the term of this patent is extended or adjusted under 35 U.S.C. 154(b) by 356 days.

(21) Appl. No.: 11/037,833

(22) Filed: Jan. 18, 2005

(65) Prior Publication Data

US 2006/0157040 A1 Jul. 20, 2006

(51) Int. Cl.
*F41A 9/68* (2006.01)

(52) U.S. Cl. ..... 124/51.1; 124/45; 124/48; 124/49

(58) Field of Classification Search ..... 124/45, 124/48, 49, 51.1, 71–77
See application file for complete search history.

(56) References Cited

U.S. PATENT DOCUMENTS 5,809,983 A * 9/1998 Stoneking ..... 124/50
6,234,157 B1 * 5/2001 Parks ..... 124/45
6,644,293 B2 * 11/2003 Jong ..... 124/52
6,722,355 B1 * 4/2004 Andrews, Jr. ..... 124/49
6,978,776 B2 * 12/2005 Hamilton ..... 124/51.1
7,000,603 B1 * 2/2006 Steenbeke ..... 124/45
7,017,569 B2 * 3/2006 Jong ..... 124/52
7,077,118 B2 * 7/2006 Lewis ..... 124/45
2002/0020402 A1 * 2/2002 Kotsiopoulos ..... 124/76
2002/0059927 A1 * 5/2002 Woods ..... 124/45
2004/0194772 A1 * 10/2004 Hamilton ..... 124/45
2005/0028801 A1 * 2/2005 Lewis ..... 124/45
2005/0166904 A1 * 8/2005 Friesen et al. ..... 124/45
2006/0042614 A1 * 3/2006 Broersma ..... 124/49

* cited by examiner

*Primary Examiner*—Troy Chambers
(74) *Attorney, Agent, or Firm*—Keisling Pieper & Scott PLC; David B. Pieper; Trent C. Keisling

(57) ABSTRACT

Each of a set of substitutable paintball magazines quickly attaches to a coupling feeder mounted on the ammunition intake port of a paintball marker, replacing the traditional hopper and sets of paintball cartridges. The coupling feeder includes a motor-driven paintball feeding mechanism. Each magazine has a lid that automatically moves out of the way as the magazine is mated to the coupling feeder, allowing the balls in the magazines to roll toward the feeding mechanism

10 Claims, 3 Drawing Sheets

HOPPERLESS PAINTBALL LOADING DEVICE

FIELD OF THE INVENTION

This invention relates to ammunition magazines and more specifically to magazines for dispensing uniformly-sized spherical projectiles such as frangible paintballs into a gun adapted to shoot said projectiles.

BACKGROUND OF THE INVENTION

Pneumatically-operated projectile launching devices such as paintball guns, also called paintball markers, have been enhanced to provide a rapid and sustained firing of a large quantity of projectiles. One of such devices is disclosed in U.S. Pat. No. 6,474,326 Smith et al. Large capacity projectile loading and feeding hoppers and magazines are provided to mount above the feeding port of the gun positioned above the breech section. Such a holding and loading magazine is disclosed in U.S. Pat. No. 6,725,852 Yokota et al. Some projectile loading and feeding implements combine a hopper mounted on the feeding port of the gun and a loading magazine adapted to dump its contents into the hopper as disclosed in U.S. Pat. No. 5,809,983 Stoneking. The aforesaid three patents are incorporated in this specification by this reference.

During a paintball game, a large quantity of paintballs may be used by each participant. Encumbered by a protective armor and gloves, an partially blinded by a face mask whose lens may have been splattered with paint, a player lacks the dexterity to reload his gun from a sealed magazine. While magazines that can be manipulated and opened with a single hand have been offered in the past, balancing the gun and its ammunition hopper with one hand and manipulating a projectile magazine with the other still requires a great deal of time and attention.

The present invention was devised in an attempt to speed the reloading of a paintball gun in the heat of the battle.

SUMMARY OF THE INVENTION

The principal and secondary objects of this invention are to provide an ammunition loading and feeding device that can be quickly operated with a single hand, and to eliminate the traditional cumbersome, bulky, and heavy hopper.

These and other valuable objects are achieved by an ammunition feeding device that can accommodate a number of magazines of different projectile-holding capacities and can be quickly and single-handedly connected with a compact ammunition feeding mechanism mounted into the ammunition intake port of the gun. Each magazine has a dumping end closed by a resiliently biased gate that opens automatically as the magazine is mounted on the feeding mechanism.

DESCRIPTION OF THE PREFERRED EMBODIMENT OF THE INVENTION

Figure 1:
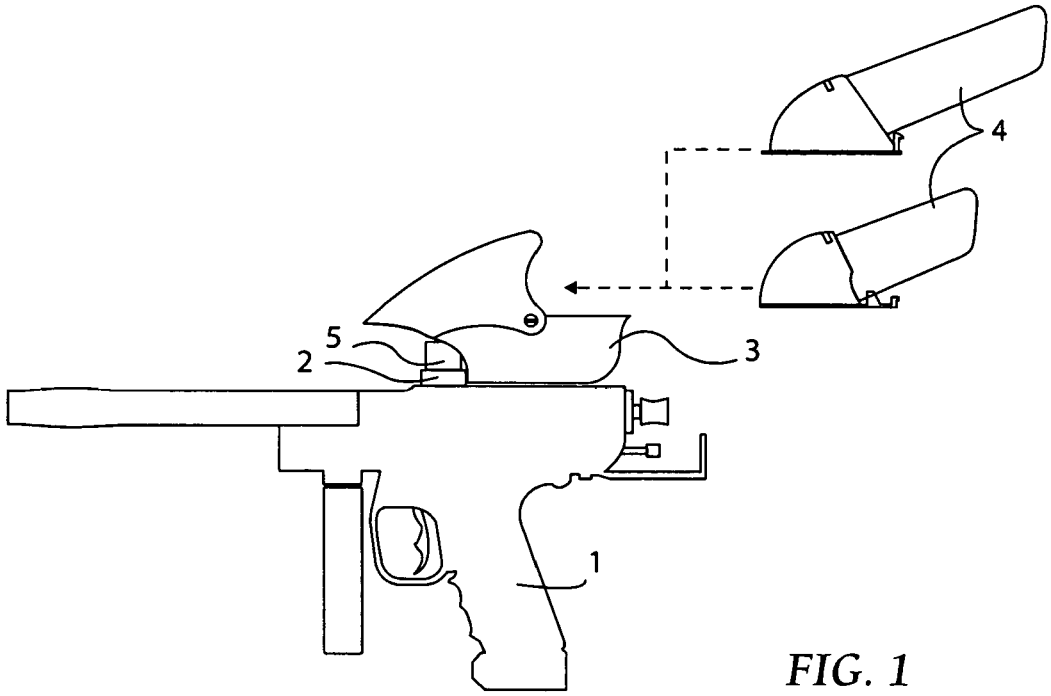
FIG. 1 is a diagrammatic illustration of the loading device according to the invention.

Referring now to the drawing, there is shown in FIG. 1, a paintball gun or marker of the type disclosed in the first-mentioned of the above-referenced patents, having an ammunition intake port 2. A paintball feeder 3 acts as a coupler between the gun 1 and one of a set of paintball magazines 4 of equal or different capacities.

Figure 2:
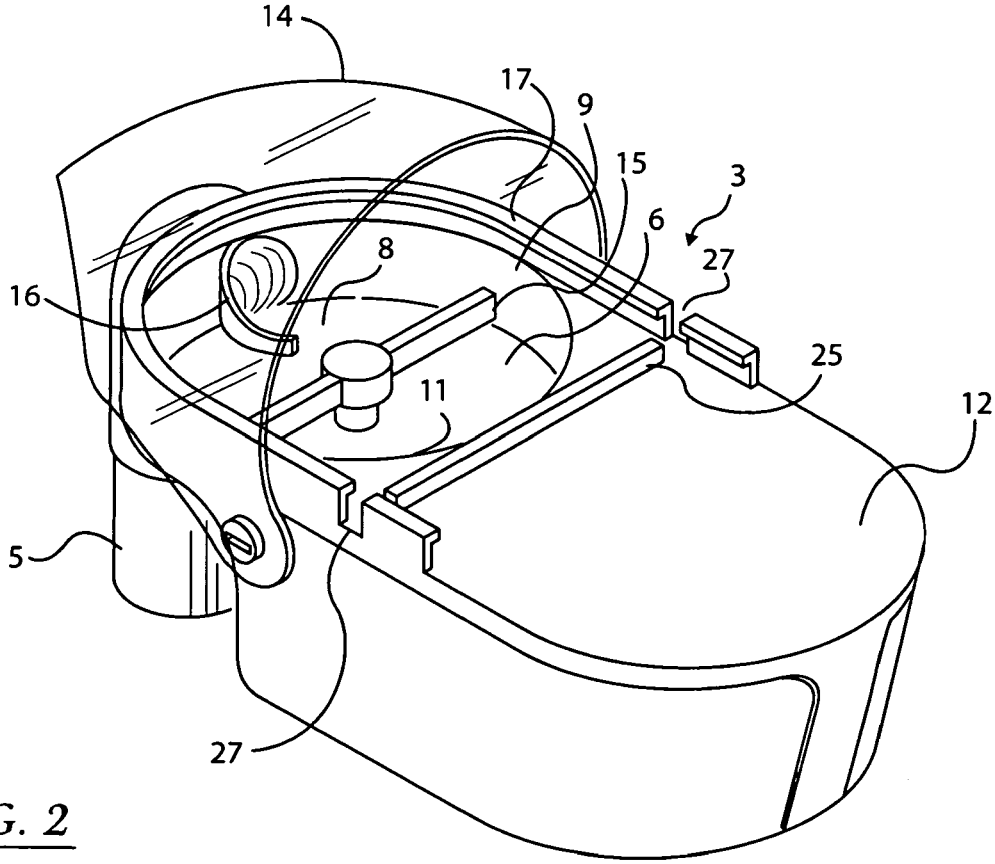
FIG. 2 is a top perspective view of the paintball feeder.
Figure 6:
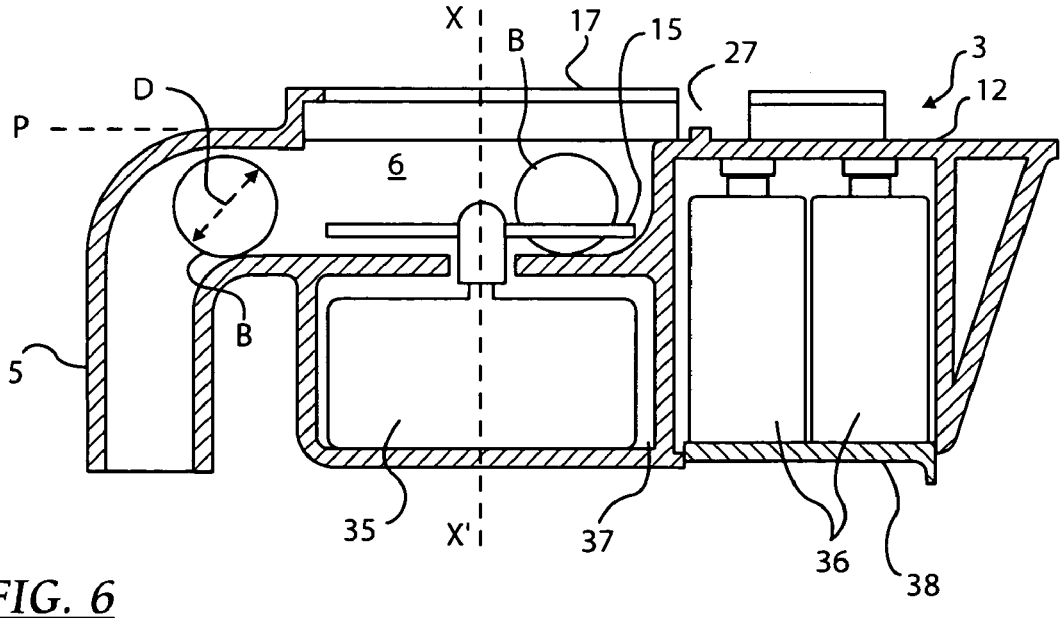
FIG. 6 is a cross-sectional view of the feeder.

As more specifically illustrated in FIGS. 2 and 6, the ammunition feeder has an exit spout 5 in a lower section that is inserted into the intake port 2 of the gun. The exit spout is shaped to tightly and securely mate with the intake port without need and in the absence of any other securing or locking mechanism, and only by friction between the mating surfaces. The high level of friction is achieved by either slightly tapering the wall of the mating surface or by providing longitudinal ridges on one of the mating surfaces. This type of coupling is easily detached by slight rocking or twisting of the mating parts.

Figure 3:
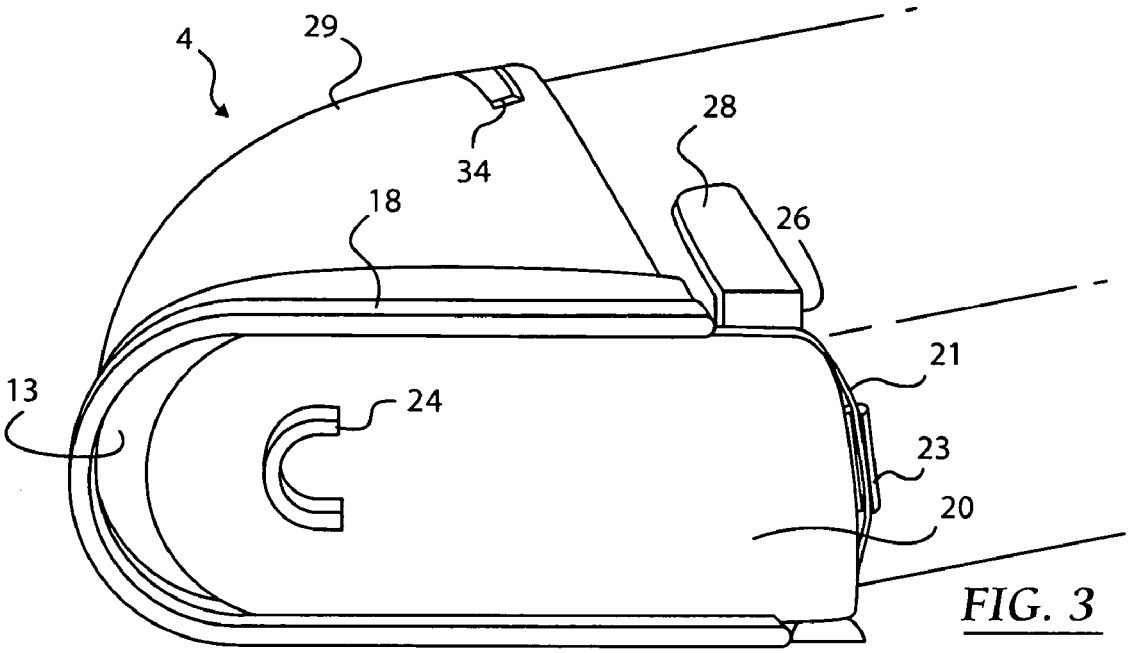
FIG. 3 is a perspective view of the magazine dumping end.
Figure 4:
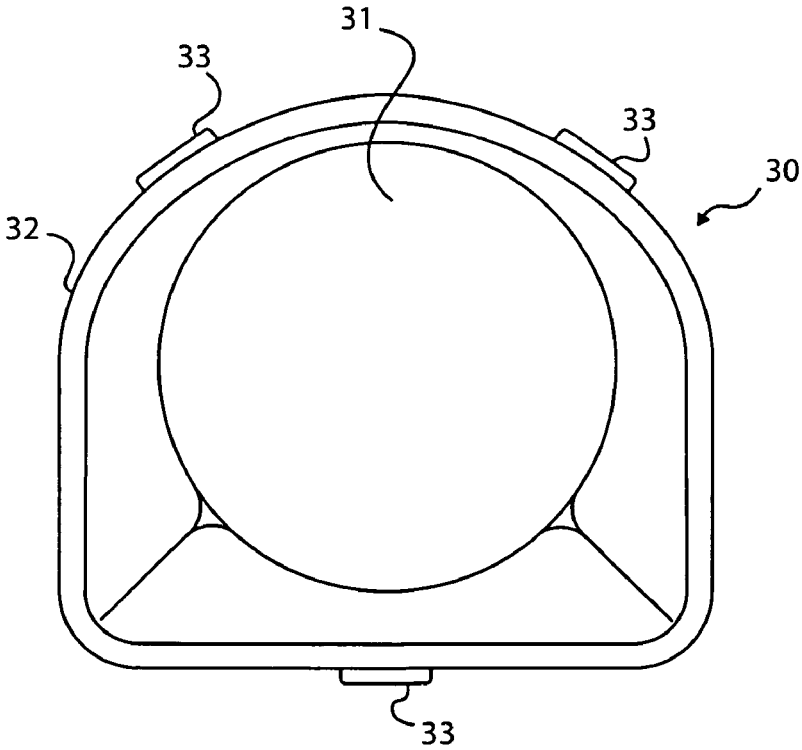
FIG. 4 is a frontal perspective view of the magazine tubular section.
Figure 5:
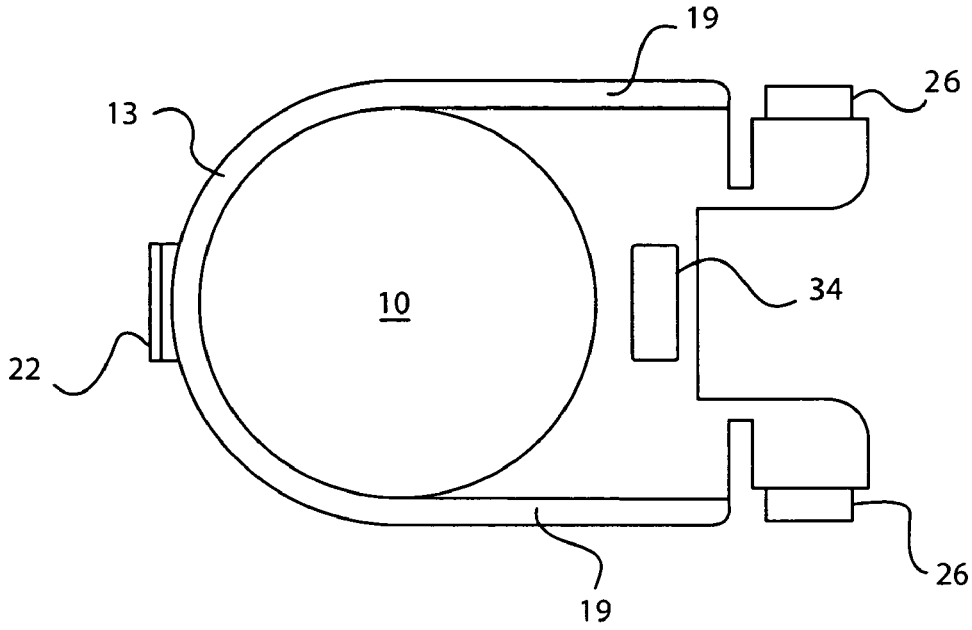
FIG. 5 is a top plan view of the magazine dumping end with the gate removed.

The feeder 3 has an open cavity 6, in an upper section, that defines a shallow well whose depth is substantially equal to the common diameter D of the paintball projectiles. The spout 5 has an opening 8 in the lateral wall 9 of the cavity. The brim around the cavity is shaped and dimensioned to match the aperture 10 at the dumping end of each of the magazines whose geometry is more specifically illustrated in FIGS. 3-5. Alongside the cavity 6 and in the same plane as its brim 11 is a platform 12 that acts as a landing surface for the rim 13 surrounding the aperture of the magazine. A quarter-spherical, transparent hood 14 extends over the cavity 6. An impeller 15 at the bottom of the cavity has two arms shaped and dimensioned to sweep a paintball that may be present into the well toward the spout opening 8. A vertical, shallow baffle 16 along one side of the opening guides the ball toward it. A horseshoe-shaped, grooved rail 17 is formed around the brim of the cavity. The rail is shaped and dimensioned to engage a corresponding outwardly flanged rail 18 formed around the rim 13 of the magazine. A pair of parallel slotted rails 19 astride the opening of the magazine are engaged by a gate 20 shaped and dimensioned to slide across and close the magazine aperture 10. The gate is resiliently biased toward the closed position by an elastic band 21 captured by a first slotted stub 22 at the forward end of the magazine rim and a second similar stub 23 located at the rear end of the gate.

When the dumping end of the magazine is positioned over the landing platform 12 and slid toward the cavity 6, the rail 18 around the rim of the magazine is captured by the groove rail 17 around the brim of the feeder. A small projection 24 extending from the lower surface of the gate 20 comes in contact with a barrier 25 positioned transversally between the cavity 6 and the platform 12. The gate is resiliently held back against the elastic band 21 freeing the aperture 10 and allowing paintballs stored into the magazine to drop into the well 6. When the rim of the magazine is fully mated to the brim of the cavity, a pair of lateral wings 26 which are forced inwardly by contact with the grooved rail 17 snap back into a pair of corresponding cutouts 27, providing a positive locking of the magazine onto the feeder. The magazine can be released by pressing inwardly the tabs 28 associated with the wing. As the magazine is withdrawn onto the platform 12, the gate 20 slids back across the aperture 10 under the pull of the elastic band 21.

Each magazine comprises a base 29 and a transparent tubular section 30. The tubular section has a circular back end 31 and a substantially semi-circular front end 32. Stubs 33 projecting outwardly around the frontal periphery of the tubular section are engaged in to corresponding slots 34 in the base 29.

As more specifically illustrated in FIG. 6, the propeller 15 is driven by an electrical motor 35. The axis X-X' of the motor is substantially perpendicular to the plane P-P' of the rim and platform. The motor is housed along with its powering batteries 36 in the enclosure 37 formed under the cavity and platform.

It should be understood that other means than an elastic band can be used to resiliently force the retractable gate 20 across the opening 10 of the magazine, such as a spring. A gate 38 can be slid away to provide access to the batteries.

While the preferred embodiments of the invention have been described, modifications can be made and other embodiments may be devised without departing from the spirit of the invention and the scope of the appended claims.

What is claimed is:

1. A device for feeding spherical projectiles of a common given diameter into the ammunition intake port of a gun, which comprises: a plurality of projectile magazines, each of said magazines including a dumping end having an opening, and comprising a gate resiliently biased to close said opening; an electro-mechanical feeder including: a housing having an open cavity defining a shallow well and an exit spout shaped and dimensioned to mate with said intake port; said well having a lateral wall, a brim lying in a plane, and a depth substantially equal to said diameter; an impeller in said well having at least one arm shaped, dimensioned and positioned to sweep a projectile in said well into said exit port; and a locking structure around said brim, said structure including a member positioned to force open said gate when said opening is mated with said brim.

2. The device of claim 1, wherein said gate is positioned to slide across said opening; and said feeder further includes a platform having a landing surface lying in said plane, alongside said brim, said platform being shaped and dimensioned to substantially mate with said dumping end.

3. The device of claim 2, wherein said dumping end further comprises an outwardly flanged rim; and said platform and brim comprise a pair of lateral grooved rails shaped and positioned to capture said flanged rim when said dumping end is slid over said platform and moved over said brim.

4. The device of claim 3, wherein said magazine has a substantially tubular shape and a longitudinal axis, and said rim and gate lie in a plane obliquely to said axis.

5. The device of claim 4, wherein said feeder further comprises a barrier between said platform and brim.

6. The device of claim 4, wherein said housing comprises a substantially quarter spherical hood extending over said well.

7. The device of claim 1, wherein said feeder further comprises a motor driving said impeller.

8. The device of claim 4, wherein said housing further comprises means for detachably locking said magazine onto said feeder.

9. The device of claim 7, wherein said feeder further comprises a source of electrical energy powering said motor.

10. The device of claim 1, wherein said impeller rotates about an axis perpendicular to said plane; and said spout has an aperture in said lateral wall.

* * * * *